United States Patent [19]

Herrin et al.

[11] 4,054,109

[45] Oct. 18, 1977

[54] ENGINE WITH VARIABLE VALVE OVERLAP

[75] Inventors: Ronald J. Herrin, Clawson; Donald J. Pozniak, Sterling Heights, both of Mich.

[73] Assignee: General Motors Corporation, Detroit, Mich.

[21] Appl. No.: 672,474

[22] Filed: Mar. 31, 1976

[51] Int. Cl.[2] ..... F01L 1/34; F01L 1/14

[52] U.S. Cl. ..... 123/90.16; 123/90.55; 123/90.56

[58] Field of Search ..... 123/90.16, 90.35, 90.43, 123/90.46, 90.55, 90.63, 90.56, 90.57, 90.58, 90.59

[56] References Cited

U.S. PATENT DOCUMENTS

| | | | |
|---|---|---|---|
| 2,309,740 | 2/1943 | Voorhies | 123/90 |
| 2,339,238 | 1/1944 | Buckley | 123/90.56 |
| 2,614,547 | 10/1952 | Meinecke | 123/90 |
| 2,634,714 | 4/1953 | Randol | 123/90.55 |
| 2,695,013 | 11/1954 | Randol | 123/90.55 |
| 2,804,864 | 9/1957 | Roan | 123/90 |
| 2,818,050 | 12/1957 | Papenguth | 123/90 |
| 2,833,257 | 5/1958 | Lengnick | 123/90 |
| 2,931,347 | 4/1960 | Williams | 123/90 |
| 2,940,433 | 6/1960 | Randol | 123/90.55 |
| 3,361,122 | 1/1968 | Wagner | 123/90 |
| 3,385,274 | 5/1968 | Shunta | 123/90 |
| 3,406,668 | 10/1968 | Donnelly | 123/90.56 |
| 3,439,661 | 4/1969 | Weiler | 123/90 |
| 3,742,921 | 7/1973 | Rendine | 123/90.55 |

*Primary Examiner*—Ronald H. Lazarus
*Assistant Examiner*—Daniel J. O'Connor
*Attorney, Agent, or Firm*—Robert J. Outland

[57] ABSTRACT

Variable overlap of the intake and exhaust valve opening periods for an internal combustion engine is obtained by providing a speed responsive yieldable link in the valve actuating mechanism that varies the effective valve lift with engine speed. The variation is accomplished by flow responsive valves, preferably incorporated in hydraulic tappets for actuating the valves and arranged to begin valve lift only when a predetermined lift rate of the valve actuating cam is reached. Since this rate is reached earlier as the engine speed increases, a greater portion of the cam lift curve is utilized with increased speed, thus increasing the valve lift and extending the valve opening period relative to crankshaft rotation. In this way, angular overlap of the intake and exhaust valve opening periods is varied as a function of engine speed.

7 Claims, 7 Drawing Figures

ENGINE WITH VARIABLE VALVE OVERLAP

BACKGROUND OF THE INVENTION

This invention relates to internal combustion engines and, more particularly, to means for varying valve timing and intake and exhaust valve overlap in an internal combustion engine, particularly of the four stroke spark ignition type. In its more particular aspects the invention relates to valve actuating means variably yieldable as a function of engine speed to change with speed the effective lift and opening periods of intake and exhaust valves and thus vary the valve overlap with changes in engine speed. The invention also relates to a hydraulic valve tappet including means for varying its effective actuating length as a function of engine speed.

It is well known in the art that the fixed valve timing of internal combustion engines intended for variable speed operation, particularly of the four stroke cycle spark ignition type commonly used in automotive vehicles, represents a compromise as to engine operating efficiency and characteristics which could be improved by using mechanism for varying the valve timing with speed to obtain the proper timing for best operation at each engine operating speed. Among the valve operating characteristics, it is recognized that some variation with speed of overlap in the opening periods of the intake and exhaust valves is desirable. Thus, relatively small overlap or none at all would be provided for low engine speeds, while substantially greater valve overlap would be provided at increased engine speeds. In addition, it is desirable that the opening periods of individual valves be shortened at low engine speeds to correspond more closely with the extent of the intake or exhaust strokes of their respective pistons, while at higher speeds, better breathing results from increasing the times of opening of the valves with respect to crankshaft rotation.

The prior art is replete with mechanisms intended for use in obtaining variable valve timing and variable valve overlap to obtain some or all of the advantages possible for such mechanisms. In general, however, such mechanisms are not known to have been used in commercial engines. U.S. Pat. No. 3,385,274 Shunta et al. refers in its specification to a number of patents disclosing prior art mechanisms of this sort and itself discloses one arrangement for accomplishing variable valve lift, timing and overlap.

SUMMARY OF THE INVENTION

The present invention provides an arrangement for providing variable lift, timing and overlap of the valves of internal combustion engines as a function of engine speed, which is based upon a concept and operates in a manner differing from any of the known prior art arrangements and yet accomplishes the desired functions with a very simple mechanism that may involve only slight modification of well-known commerical devices.

The invention utilizes a variably yieldable load carrying member in the actuating mechanisms of one or both of the intake and exhaust valves of each cylinder of the associated engine. The yieldable member is designed with a characteristic which permits it to delay valve opening by freely yielding upon actuation by its respective actuating cam until a predetermined rate of cam lift is reached. At this point the yieldable member goes solid and lifts the valve on a curve determined by the remaining portion of the associated lift cam. In effect, the valve lift and timing are varied through using a greater or lesser portion of the cam lift curve in opening the valve. Because of the arrangement of the mechanism, a reduction of valve lift also results in retarding the timing of valve opening and advancing the timing of valve closing. Thus, when such a mechanism is used on both the intake and exhaust valves of an engine cylinder, the valve overlap period is changed by the total of the amount of change in the timing of exhaust valve closing and timing of intake valve opening.

The invention further provides mechanisms for accomplishing the desired variable valve timing characteristic which may be incorporated in a novel hydraulic tappet assembly. In one form, the assembly is provided with a pressure and flow responsive check valve which, when closed, prevents the escape of hydraulic fluid from a chamber, thus preventing further shortening of the effective length of the tappet and allowing the transmission of valve opening loads therethrough. The check valve is biased slightly open and is responsive to reaching of a predetermined pressure differential, caused by flow of hydraulic fluid from the chamber past the check valve, to close the valve on reaching of a predetermined rate of flow that corresponds with a predetermined lift rate of the associated valve actuating cam. Since the predetermined or critical lift rate is reached earlier as engine speed increases, the arrangement results in increasing the valve lift and opening period and, as a result, the intake-exhaust valve overlap as engine speed is increased.

These and other advantages of the invention will be more fully understood from the following description of certain preferred embodiments, taken together with the accompanying drawings.

DETAILED DESCRIPTION

Figure 1:
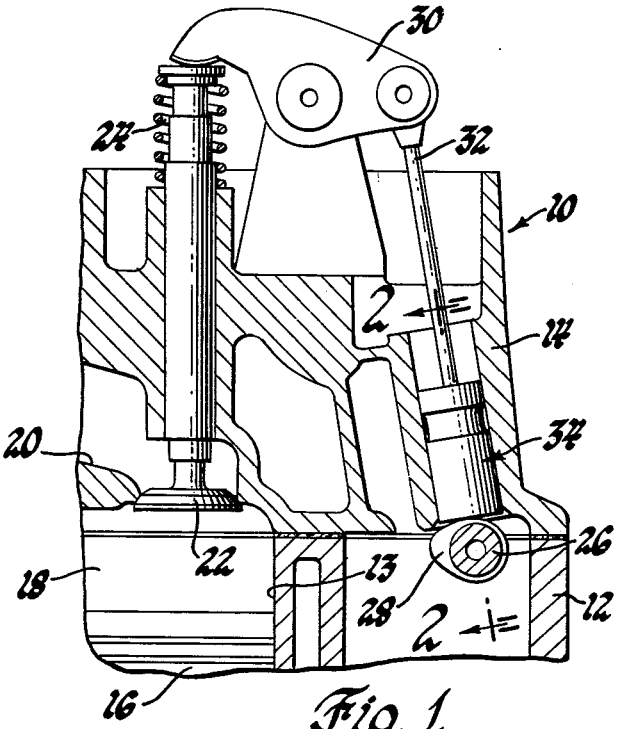
FIG. 1 is a fragmentary cross-sectional view of an internal combustion engine having valve actuating means in accordance with the invention.

In the drawings, numeral 10 generally indicates an internal combustion engine of the four stroke cycle spark ignition type. The engine has major portions of conventional construction including a cylinder block 12 defining a plurality of cylinders 13, a cylinder head 14 closing the ends of the cylinders, pistons 16 in the cylinders and cooperating with them and the cylinder head to form combustion chambers 18 at the cylinder ends, intake and exhaust ports for each cylinder, only an intake port 20 being shown, poppet valves 22, one in each of the ports and each having a spring 24 biasing its respective valve in a port-closing direction, a camshaft 26 connected with the engine crankshaft (not shown) for rotation in timed relation with the reciprocating motion of the pistons 16 and having cams 28, one of which is associated with each of the valves 22 for actuating the valve in the proper portion of each engine cycle, and interconnecting means between the valves and respective cams and including rocker arms 30, push rods 32 and hydraulic tappets 34. Except for the tappets to be subsequently described, these elements are of or are intended to represent conventional constructions which may be found in various forms in automotive vehicle engines.

Figure 2:
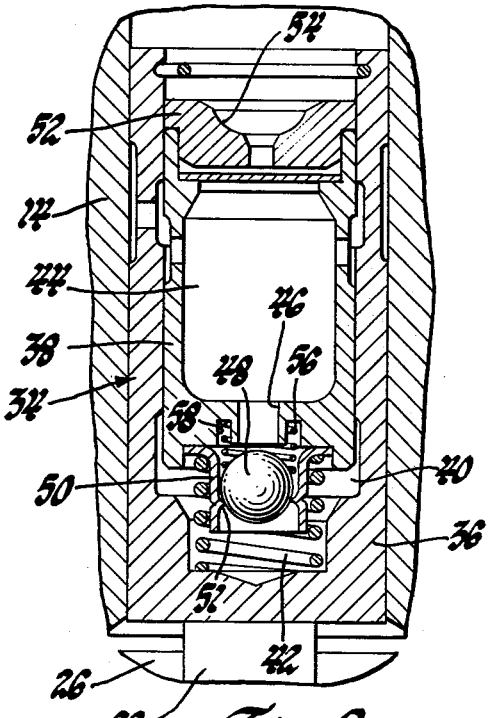
FIG. 2 is a cross-sectional view generally in the plane of the line 2—2 of FIG. 1 and illustrating the internal construction of one embodiment of speed responsive variable stroke hydraulic tappet formed according to the invention.

The construction of the hydraulic tappets, or valve lifters, 34 as shown in FIG. 2 is based on and is in many aspects similar to, the construction of commercially used hydraulic valve lifters as shown for example in FIG. 2 of U.S. Pat. No. 2,818,050 Papenguth. Thus, like Papenguth, the tappet assembly 34 comprises a cup-shaped body or cylinder member 36 having a nesting cup-shaped piston or plunger member 38 telescopically slidable therein and defining an oil pressure or cushion chamber 40 between their respective closed ends. Within the pressure chamber 40 and biasing the plunger outwardly of the cylinder 36 is a spring 42. The interior of the plunger 38 forms an oil reservoir chamber 44 for supplying the pressure chamber 40 through a port 46 in the plunger end wall controlled by a ball valve 48. A tubular cage 50 surrounding the ball and held in place against the bottom of the plunger by the spring 42 serves to retain the ball opposite the port 46 and has internal projections 51 that limit the distance the ball may move when opening the port. At its open end, piston 38 receives a push rod seat 52 having a recess 54 adapted to receive an end of the push rod 32.

The construction of the hydraulic tappets 34 differs from the prior Papenguth construction primarily in the provision of a biasing spring 56 that is seated in an annular recess 58 surrounding the port 46 in the end wall of the plunger 38. Spring 56 engages the ball valve 48 and urges it in an opening direction away from the port 46. This spring, together with various subsequently discussed design factors of the related valve elements, convert the one-way check valve of Papenguth to a two-way valve having flow responsive characteristics for oil flow out of the chamber 40, which enable the arrangement to provide the novel features of the present invention.

Figure 3:
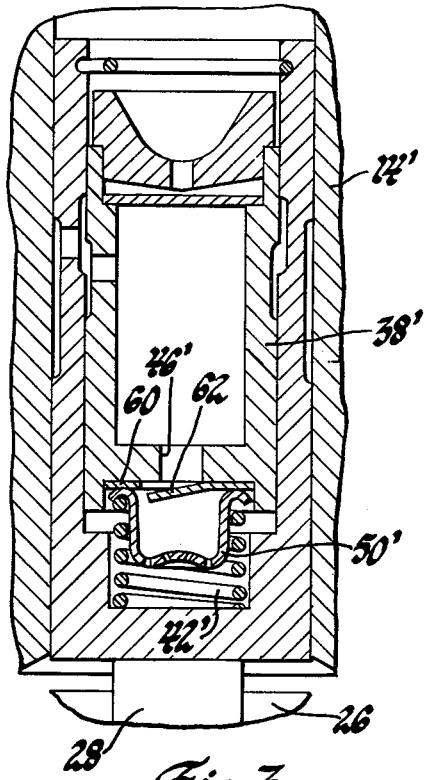
FIG. 3 is a cross-sectional view similar to FIG. 2, but showing the construction of an alternative embodiment of variable stroke hydraulic tappet.

Referring now to FIG. 3, the construction of the alternative embodiment there shown is similar to that of the embodiment of FIG. 2, with the exception of the flow responsive control valve. In the FIG. 3 embodiment, this valve comprises a thin disc member 60 held on the end of the plunger 38' by the spring 42' and cage 50'. The disc 60 integrally supports a flat reed valve 62 which is adapted to close the port 46', but is resiliently biased in an open position through internal resilient forces determined during manufacture. Preferably, the disc and reed would be made of a spring steel material, but if desired, plastic or other suitable metals could be used.

Figure 4A:
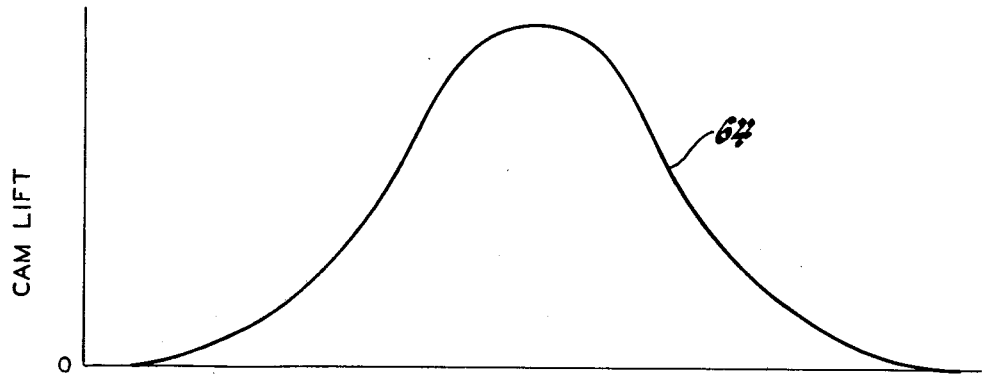
FIGS. 4*a* – 4*c* illustrate graphically the corresponding motions of cam and valve lift and the rate of cam lift for a system according to the invention operated at differing engine speeds.

The operation of the disclosed arrangements is as follows. When the engine is operating, rotation of the camshaft causes the cams 28 to periodically move the bodies or cylinder members 36 of their respective tappets upwardly through predetermined lift curves defined by the shapes of the cams. FIG. 4*a* graphically illustrates a cam lift curve 64, or the extent of movement of one tappet body 34 as a function of crankshaft angle for an exemplary cam shape. It should be understood that the shapes of cams for the inlet and exhaust valves may differ as to opening extent and valve opening period, but their general characteristics will be much like those shown in FIG. 4*a*.

If the tappet 34 were a solid member or a conventional hydraulic lifter of the Papenguth type in which so-called valve lash is minimized or substantially eliminated, movement of the tappet body 36 along the lift curve 64 of FIG. 4*a* would cause a like opening and closing motion of the associated valve, whether of the inlet or exhaust type, through the action of the interconnecting push rod and rocker arm mechanism in known fashion. However, in the arrangements of the present invention, the opening bias of the control valve caused, in the arrangement of FIG. 2, by the spring 56 allows oil to escape from the chamber 40 through the port 46 until a sufficient flow is reached to develop a differential pressure on the valve element sufficient to overcome the force of its bias and close the port 46.

The control valve elements of the disclosed hydraulic tappet arrangements are specifically designed to assure that such closure takes place when a predetermined rate of flow out of the chamber is reached. Such design involves proper selection of the valve opening bias, the size and shape of the valve closure element, whether it be a ball 48 or reed 62, and the contour of the associated caging device which directs the flow of oil around the valve closure element. In addition, consideration must be given to the oil mass and viscosity, the latter being affected by the normal operating temperature.

With such a control valve design, the effect is to permit yielding of the tappet during the initial portion of movement of the tappet body by its associated cam 28 until a predetermined critical rate is reached at which oil flow out of chamber 40 overcomes the opening bias of the control valve and closes the port 46. When this occurs, the tappet, or lifter, in effect becomes solid and further upward motion of the tappet body causes its respective valve to be opened on a curve represented by a portion of the cam lift curve of FIG. 4*a* above the point at which the initial valve motion began. Such exemplary valve lift curves 66, 68 are shown in FIG. 4*c*.

Figure 4B:
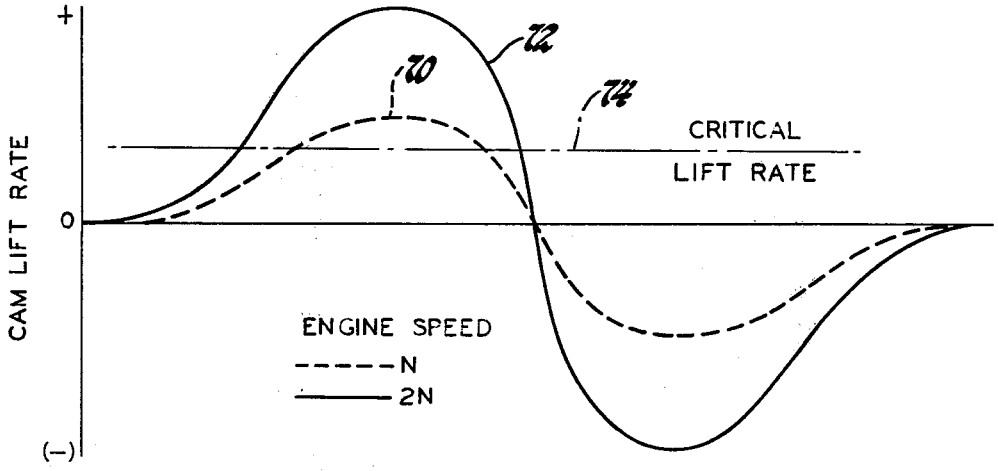
Figure 4C:
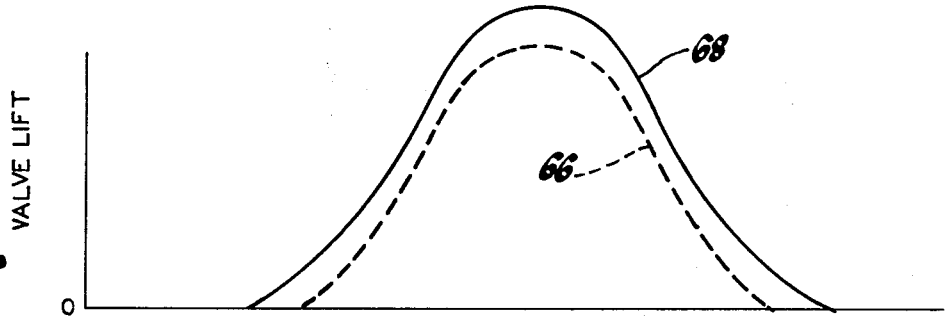

FIG. 4*b* illustrates the cam lift rates 70, 72 for a cam having the lift curve of FIG. 4*a* when the engine is operated at two different engine speeds, N and 2N respectively. As should be obvious, and is apparent from the drawing, the rates of lift of the cam vary with engine speed. Thus, the critical lift rate, which is indicated by the line 74 in the Figure, is reached at an earlier point in the cam lift curve as the engine speed is increased. Thus, while the cam lift 64 or path followed by the lifter body as illustrated in FIG. 4*a* is constant, the amount of valve opening or valve lift is something less and varies with engine speed as shown by the dashed and solid lines 66, 68 of FIG. 4*c*. More importantly, however, FIG. 4*c* also illustrates that a substantial change in timing of the opening and closing events of the valve is accomplished by the mechanism of the current invention wherein an increase in speed provides both earlier valve opening and later valve closing points.

Figure 5:
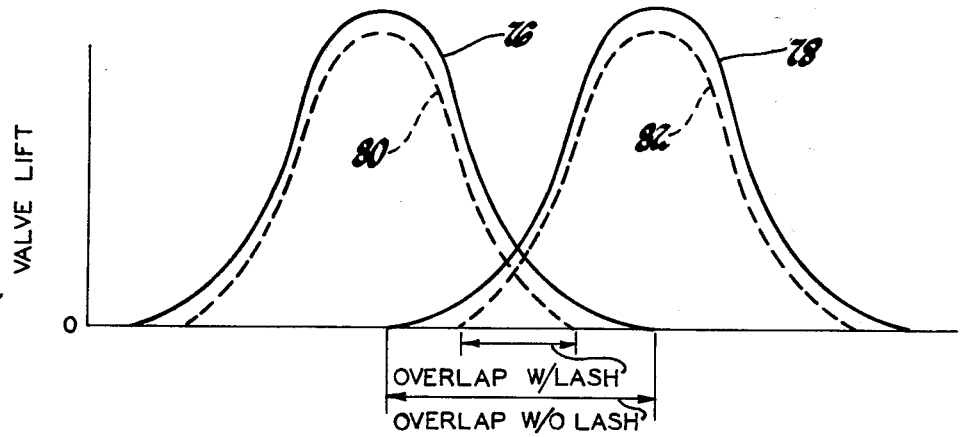
FIG. 5 illustrates graphically the manner in which the inventive arrangement varies the intake-exhaust valve overlap when operated at different engine speeds.

FIG. 5 illustrates the results of this concept when applied to both intake and exhaust valves of an engine. The solid lines 76, 78 respectively indicate the valve lift curves for the exhaust and intake valves of the same cylinder, with the engine operating at high speed and a relatively small amount of valve lash or valve lift delay being present. In this condition, both overlap and valve opening periods are at a maximum, providing the best breathing conditions for high speed operation. The dashed lines 80, 82 respectively indicate the lift curves of the same exhaust and intake valves when the engine is operated at a substantially slower speed, which results in substantially greater delay of valve lift and increased effective lash in the mechanism. Under these conditions, the valve overlap is significantly reduced and the valve opening periods are also shortened, providing better conditions for smooth running of the engine with adequate breathing capabilities for the lower speed.

While the invention has been disclosed by reference to certain preferred embodiments, it should be understood that numerous changes could be made without departing from the scope of the inventive concepts disclosed. Accordingly, it is intended that the invention not be limited, except by the language of the following claims.

What is claimed is:

1. An internal combustion engine of the type having a combustion chamber, a reciprocating valve controlling the passage of gases through an opening communicating with said combustion chamber, a camshaft having a valve actuating cam and means interconnecting said cam with said valve for actuating said valve in timed relation with engine operation, wherein the improvement comprises a yieldable load carrying member in said interconnecting means, said member having an internal chamber that is contracted upon yielding of said member and is adapted to receive a charge of hydraulic fluid which, when retained in said chamber, prevents further yielding of said member and permits the transmission of valve opening loads therethrough, and timing valve means connecting with said chamber and including a pressure responsive valve closure element, said valve closure element being biased open to permit the escape of fluid from said chamber and allow yielding of said load carrying member during initial actuating movement of the valve actuating cam, and being responsive solely to the reaching of a closing differential pressure across said element caused by fluid flow out of said chamber and sufficient to close said chamber, said valve closure element then being maintained closed by fluid pressure in the chamber so as to prevent the further escape of fluid until the fluid pressure is relieved by termination of the reciprocating valve closing motion, said valve opening bias and closing differential pressure being selected to correspond with the dimensional and operating conditions of the engine valve mechanism to provide substantial variation in the timing of said reciprocating valve opening and closing points as a function of engine speed.

2. An internal combustion engine of the type having a combustion chamber, reciprocating inlet and exhaust valves controlling the passage of gases through openings communicating with said combustion chamber, a camshaft having a valve actuating cam for each reciprocating valve and means interconnecting said cams with their respective valves for actuating said valves in timed relation with engine operation, wherein the improvement comprises a yieldable load carrying member in each said interconnecting means, each said member having an internal chamber that is contracted upon yielding of said member and is adapted to receive a charge of hydraulic fluid which, when retained in said chamber, prevents further yielding of said member and permits the transmission of valve opening loads therethrough, and timing valve means connecting with said chamber and including a pressure responsive valve closure element, said valve closure element being biased open to permit the escape of fluid from said chamber and allow yielding of said load carrying member during initial actuating movement of its respective valve actuating cam, and being responsive solely to the reaching of a closing differential pressure across said element caused by fluid flow out of said chamber and sufficient to close said chamber, said valve closure element then being maintained closed by fluid pressure in the chamber so as to prevent the further escape of fluid until the fluid pressure is relieved by termination of the closing motion of the respective reciprocating valve, said valve opening bias and closing differential pressure being selected to correspond with the dimensional and operation conditions of the engine and valve mechanism to provide substantial variation in the timing of the opening and closing points of the respective reciprocating valves as a function of engine speed.

3. The combination of claim 2 wherein the open periods of the intake and exhaust valves for said combustion chamber have a substantial overlap during at least some modes of engine operation, the variable yielding of said load carrying members with speed being effective to vary said overlap of the open periods of the intake and exhaust valves with speed.

4. A hydraulic tappet comprising a cylinder member closed at one end, a piston member slidably received in said cylinder member and defining at the closed end thereof a chamber adapted to be filled with hydraulic fluid which when trapped therein prevents movement of said piston in a direction to shorten the effective length of said tappet, valve means in one of said cylinder and piston members and including a port connecting with said chamber for the passage of fluid therethrough, a valve closure element movable to open or close said port and positioned such that fluid flow from said chamber creates a fluid pressure differential across the closure element that urges said closure element in a port closing direction, said closure element being biased in an opening direction and movable in a closing direction solely by said pressure differential, whereby said tappet is compressively yieldable up to a predetermined rate of compression at which the force of fluid flow from said chamber is sufficient to close said valve closure element against the force of said bias, thus preventing further yielding until a reduction of the tappet load allows said bias to open the closure element against the force of fluid pressure in said chamber.

5. The combination of claim 4 wherein said valve closure element is resiliently deformable and provides said bias internally.

6. The combination of claim 4, wherein said valve means further includes spring means engaging said valve closure element and supplying said opening bias.

7. The combination of claim 4 wherein said port is in said piston, said valve closure element is in said chamber and said valve means further comprises caging means retaining said closure element opposite said port and limiting its opening movement and spring means acting between said piston and said closure element to provide said opening bias.

* * * * *